US006811223B2

(12) United States Patent
Ito

(10) Patent No.: US 6,811,223 B2
(45) Date of Patent: Nov. 2, 2004

(54) STRETCHER

(76) Inventor: Tsunetaro Ito, 3587-1, Kodaira, Nishiharuchika, Ina-shi, Nagano-ken (JP)

( * ) Notice: Subject to any disclaimer, the term of this patent is extended or adjusted under 35 U.S.C. 154(b) by 0 days.

(21) Appl. No.: 10/277,621

(22) Filed: Oct. 22, 2002

(65) Prior Publication Data

US 2003/0173812 A1 Sep. 18, 2003

(51) Int. Cl.[7] ..... A47C 1/10

(52) U.S. Cl. ..... 297/408; 5/636; 5/622; 297/409

(58) Field of Search ..... 297/411.36, 410, 297/303, 344.14, 284.7, 408, 409; 248/405, 406.1, 413, 414; 403/368, 373, 374.1–374.4; 5/622, 639, 640, 643, 636

(56) References Cited

U.S. PATENT DOCUMENTS 1,054,063 A * 2/1913 Warren ..... 403/368
2,625,861 A * 1/1953 Swanson ..... 269/157
4,804,171 A * 2/1989 Dornfeld ..... 269/138
5,177,823 A * 1/1993 Riach ..... 5/636
5,427,436 A * 6/1995 Lloyd ..... 297/408
5,711,576 A * 1/1998 Olson et al. ..... 297/353
6,126,159 A * 10/2000 Dornfeld ..... 269/138
6,619,878 B2 * 9/2003 Wang et al. ..... 403/374.3

* cited by examiner

*Primary Examiner*—Peter R. Brown
(74) *Attorney, Agent, or Firm*—Webb Ziesenheim Logsdon Orkin & Hanson, P.C.

(57) ABSTRACT

Disclosed is a stretcher with a first shaft that is fixed onto a frame of the stretcher. A second shaft is provided on a head rest. A support arm is installed on the first shaft in a way that it can rotate, and also that supports the second shaft in a way that it can rotate. A rotation prevention member has a being pressed sloped part that receives a pressing force, and a pressing part that is pressed onto the circumference surface of the first shaft or the second shaft, and which can come near to or separate from the first shaft or the second shaft. A wedge shaped member has the pressed sloped part that presses while sliding on the being pressed sloped part of the rotation prevention member, and which presses the rotation prevention member onto the first shaft or the second shaft by the wedge action caused between this press sloped part and the being pressed sloped part. The means to apply a load which adds a load onto the wedge shaped member and also which maintains the state in which the first shaft and the second shaft are tightened.

8 Claims, 13 Drawing Sheets

STRETCHER

BACKGROUND OF THE INVENTION

1. Field of the Invention

This invention relates to a stretcher on which a patient can ride and with which the patient can be moved. In particular, this invention relates to the stretcher which is equipped with a head rest on the part that supports the head of a patient.

2. Description of the Related Art

A stretcher which can carry a patient who has difficulty getting up by himself or an older person (in this Description, they are simply called the "patient"), has been used. Using a stretcher, it is possible to move the patient while he is lying on his back just as in a bed, and also it can be changed to the seating position by making the stretcher into the shape of a chair.

Also, the stretcher which is equipped with a head rest on the part that supports the head of the patient, and of which both the angle and the depth (the height when used as a bed) of the head rest can be adjusted, so that it can offer a relaxed posture for the user, has been used. The mechanism to make this type of adjustment is constructed by including a link such as a support arm, etc., between, for example, the head rest and the back support part.

In such an adjusting mechanism, namely in the angle adjusting mechanism or the positioning mechanism, the angle or the position must be fixed except during the angle adjusting time or during the depth adjusting time. Therefore, for example, a rotation prevention mechanism, etc., which utilizes the frictional force of tightening a multi-layered clutch plate, has been used.

However, according to the existing rotation prevention mechanism as described above, multiple rotation prevention mechanisms are provided individually for each rotating kinetic pair (namely, the rotating pair between the frame and the support arm, and the rotating pair between the support arm and the head rest). Therefore, each mechanism must be adjusted individually. For instance, in the case when both the depth of the head rest and the angle must be adjusted, first, the depth is adjusted and it is fixed in the desired position, and thereafter, the angle is adjusted and fixed, thus, it must be adjusted step-wise. In addition, even in the case when only the depth is adjusted, the angular adjustment becomes necessary accompanying that, and, thus, the adjustment procedure often requires extra work. In addition, the angle adjusting mechanism and the positioning mechanism each need a rotation prevention mechanism, so that there is a disadvantage for reducing the number of parts or making it of a smaller scale, also.

SUMMARY OF THE INVENTION

Therefore, the objective of this invention is to offer a stretcher in which the depth adjustment of the head rest and the angle adjustment can be done at the same time.

In order to achieve this objective, the invention is a stretcher that is equipped with:

a first shaft that is fixed onto the frame of the said stretcher;

a second shaft that is provided on the head rest;

a support arm that is installed on the first shaft in the way that it can rotate, and also that supports the second shaft in the way that it can rotate;

a rotation prevention member that has a sloped part that can be pressed when it receives a pressing force, and the pressing part that is pressed onto the circumference surface of the first shaft or the second shaft, and which can come near to or separate from the first shaft or the second shaft;

a wedge shaped member that has a sloped pressing part that presses while sliding on the being pressed sloped part of the said rotation prevention member, and which presses the rotation prevention member onto the first shaft or the second shaft by the wedge action caused between this pressing sloped part and the being pressed sloped part;

and the means to apply the load which adds a load onto the said wedge shaped member and also which maintains the state in which the first shaft and the second shaft are tightened;

and in which the angle around the first shaft of the support arm and the angle of the head rest to this support arm can be fixed at the same time, in the stretcher that has a head rest for supporting the head of the patient.

In this stretcher, the support arm can rotate around the first shaft, and also, the head rest can rotate around the second shaft that is supported by this support arm. And, when a load is not added via the load adding means, or when the load is small even if it is added, both shafts can rotate relative to the support arm, so that the angle around the first shaft of the support arm and the angle of the head rest to the support arm can be adjusted. Therefore, the depth of the head rest and the angle can be adjusted.

On the other hand, in the case when a sufficient load is applied on the wedge shaped member, the wedge shaped member is pressed onto the rotation prevention member side. At this time, the pressing sloped part of the wedge shaped member presses while sliding the being pressed sloped part of the rotation prevention member, and by the action of the wedge, namely, the action of obtaining a large force with a small stroke by transferring the pressing force via both sloped parts, these rotation prevention members are powerfully pressed onto each shaft. As a result, each shaft is tightened between the rotation prevention member and the support arm, and the rotational movement relative to the support arm is prevented. In addition, the action to attain this rotation prevention is not done in sequence for each shaft but is done together at the same time for both shafts by operating the load adding means on the wedge shaped member, therefore, the depth adjustment of the head rest and the angle adjustment can be done simultaneously. In addition, at this time, it also becomes possible to prevent the relative rotation of each shaft at the same time by squeezing the shafts at almost the same time.

In the stretcher, the first shaft and the second shaft are in parallel, and the rotation prevention member is comprised of a pair of members that press these shafts from the inside to the outward direction, and the wedge shaped member is such that its sloped pressing part has a trapezoidal shape that is comprised of a pair of sloped flat surfaces or surfaces that are similar to that, and which exists between a pair of rotation prevention members, and which presses the two shafts to the outside by being loaded by the load applying means.

In this case, when the load is applied on the wedge shaped member, the rotation prevention members on both sides are pressed toward the outside by the wedge action caused between the sloped parts, and it tightens the shaft between the pressing parts of this rotation prevention member and the support arm. By this, the relative rotational movement of the two parallel shafts to the support arm is prevented at almost the same time, or it can allow movement at almost the same time by removing the load.

A stretcher equipped with a head rest to support the head of the patient is equipped with:

a first shaft that is fixed onto the frame of the said stretcher;

a second shaft that is provided on the head rest;

a support arm that is installed on the first shaft in a way that it can rotate, and also that supports the second shaft in a way that it can rotate;

a wedge shaped member which can move in the direction to contact to the first and the second shafts, and which presses each shaft directly or indirectly by the wedging action on the sloped surfaces, and by this wedging action, it tightens these shafts between it and the support arm and prevents the relative rotation;

and means to apply the load which adds a load onto the said wedge shaped member in the direction of pressing the first and the second shafts, and also which maintains the state in which each shaft is tightened, and in which the angle around the first shaft of the support arm and the angle of the head rest to this support arm can be fixed at the same time.

In the case when a sufficient load is applied to the wedge shaped member, the wedge shaped member moves in the direction in which the load is working, and it directly presses the shaft on the sloped surface. As a result, each shaft is tightened between the wedge shaped member and the support arm, and it becomes unable to rotate relative to the support arm. In addition, the action to attain this rotation prevention does not need to be done in sequence per each shaft but it can be done together at the same time for both shafts by operating the load adding means or the wedge shaped member, therefore, the depth adjustment of the head rest and the angle adjustment can be done simultaneously. In addition, at this time, it also becomes possible to prevent the relative rotation of each shaft at the same time by squeezing the shafts at almost the same time.

In the stretcher, the load applying means is a nut and bolt, and the penetrating hole that allows the screw part of the bolt to pass through is provided on one side surface of the support arm and the wedge shaped member. By tightening this nut and bolt, the load can be applied gradually to the wedge shaped member to tighten the shaft. Also, since the cases of loosening the nut and bolt are naturally rare, it is easy to maintain the condition of preventing the relative rotation of the shafts.

In the stretcher, the wedge shaped part has a concave part that keeps the head of the bolt or the nut in a way that it cannot rotate. Therefore, the slipping of the bolt•nut will not occur, and it can be securely tightened or released by rotating the side which is not kept in the concave part.

In the stretcher, the first shaft and the second shaft are in parallel, and one of the above mentioned penetrating holes provided on one side surface of the support arm and on the wedge shaped member is made to be a long hole that extends to both these shafts, and the wedge shaped member is made to be able to come near to or to separate from both shafts. In this case, the wedge shaped member can move just by the stroke of the long hole. Therefore, even in the case when the deviation is caused between the pressing force on one rotation prevention member and the pressing force on the other rotation prevention member, this deviation can be absorbed by the wedge shaped member by stroking to either one, and the pressing force becomes uniform, and these rotation prevention members are pressed to each shaft by almost equal forces. Therefore, both shafts become incapable of relative rotation at almost the same time, and they can become capable of allowing relative rotation at almost the same time.

DETAILED DESCRIPTION OF THE INVENTION

Figure 1:
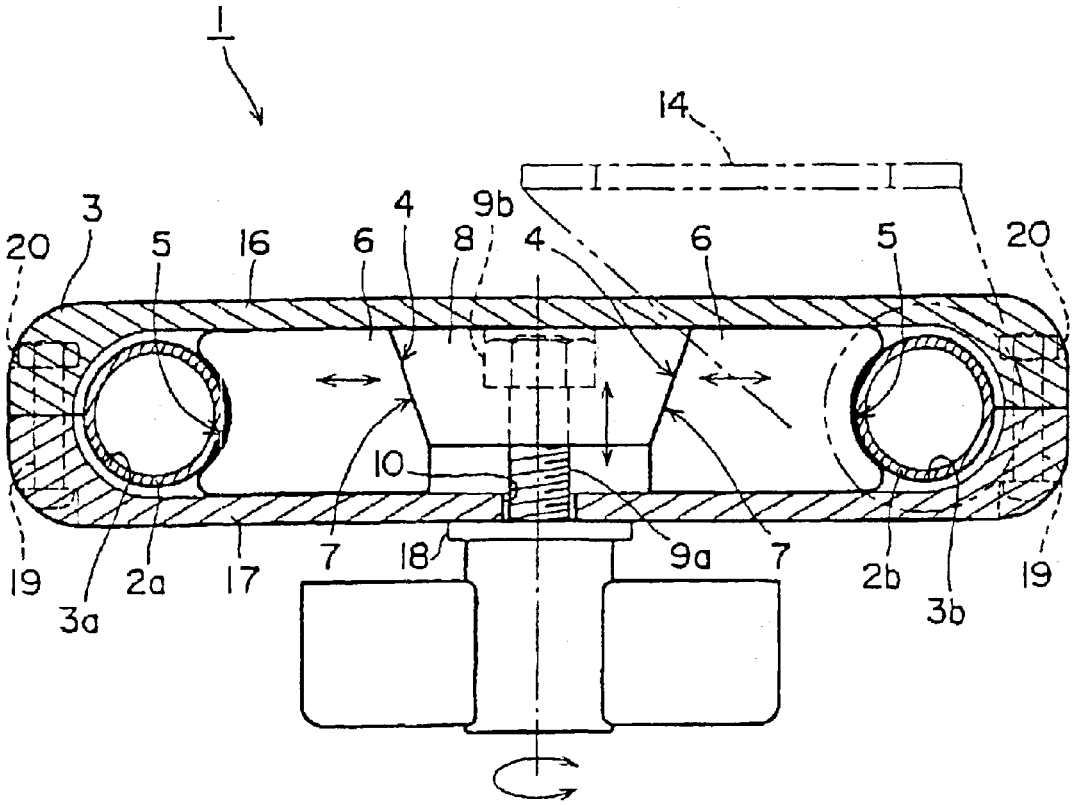
FIG. 1 is a cross section from the front that indicates a structure of a rotation prevention mechanism of a stretcher of this invention.

Next, the structure of this invention will be explained in detail based on an actual example shown in the figures.

FIGS. 1 to 16 show one actual embodiment of the stretcher 25. This stretcher 25 is equipped with the head rest 12 that supports the head of the patient, and the depth and the angle of the head rest 12 can be changed by the first shaft 2*a* that is fixed on the frame 13 of the said stretcher 25, the second shaft 2*b* that is provided on the head rest 12, and the support arm 3 that is installed on the first shaft 2*a* in a way that it can rotate and that supports the second shaft 2*b* in a way that it can rotate. Also, the stretcher 25 of this invention is equipped with the rotation prevention mechanism 1 which is comprised of the rotation prevention member 6 which has the being pressed sloped part 4 and the pressing part 5, the wedge shaped member 8 which has the pressing sloped part 7, and the load applying means 9 which applies the load on the said wedge shaped member 8, and the angle around the first shaft 2*a* of the support arm 3 and the angle of the head rest 12 to this support arm 3 can be fixed at the same time.

Figure 15:
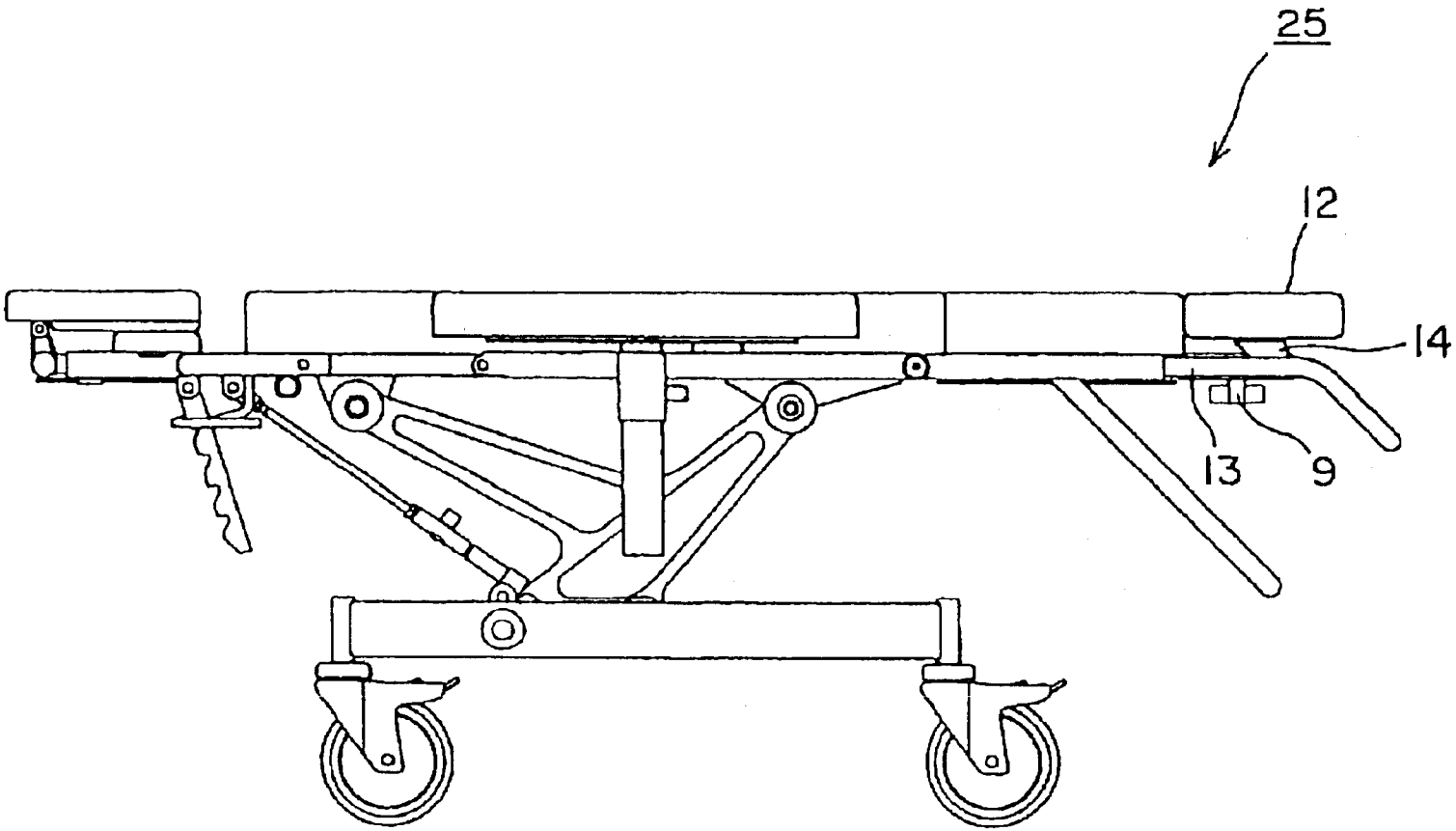
FIG. 15 is a side view of the stretcher in a bed state.
Figure 16:
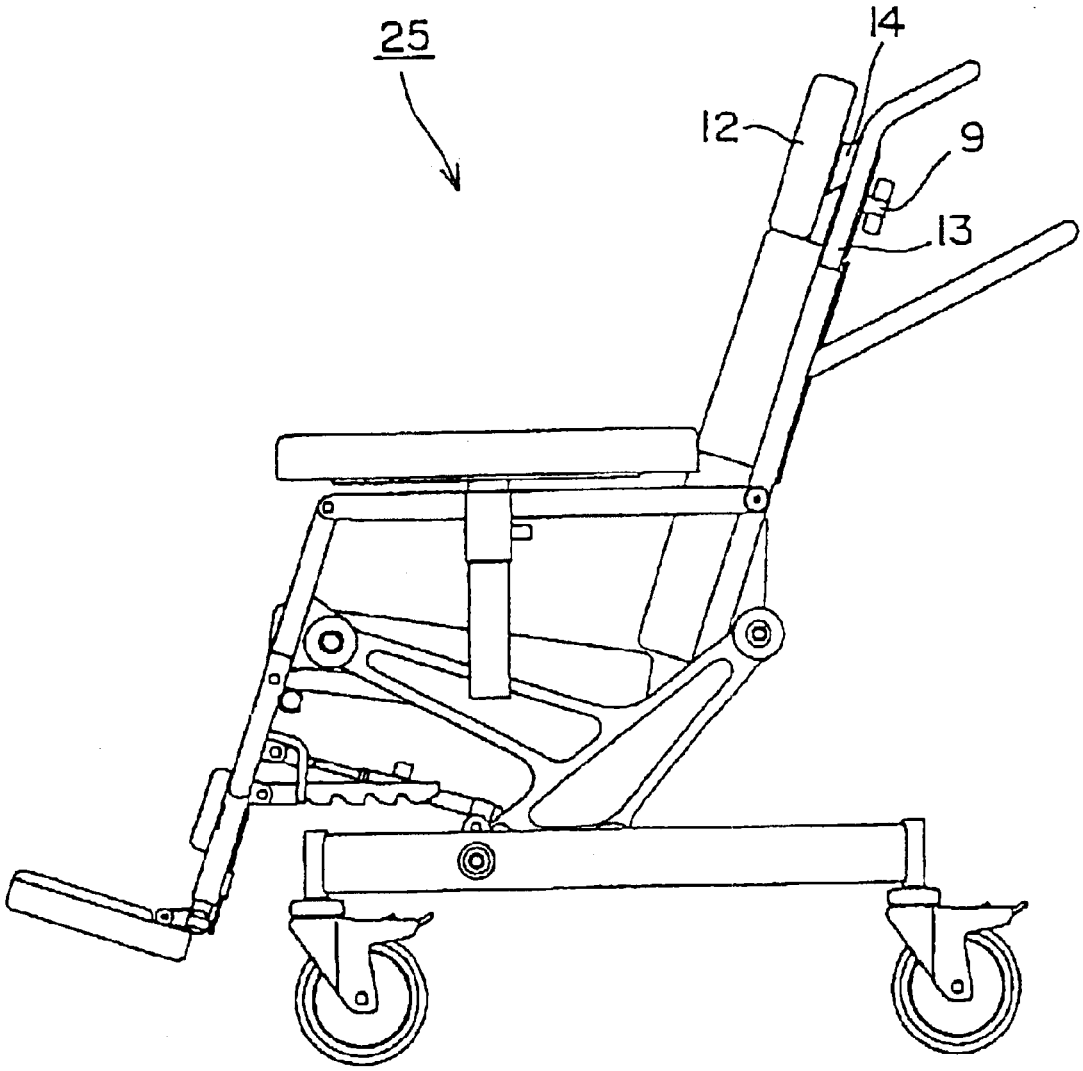
FIG. 16 is a side view of the stretcher in a wheel chair position.

The shape of the stretcher 25 can be changed into that of a bed of which the upper surface is flat, as can be seen in FIG. 15, or into the shape of a seat on which the patient can sit on, as can be seen in FIG. 16, so that the patient can be carried in the lying position or in sitting position, and also, it can be changed from the bed state to the wheel chair state or vice versa while the patient is riding on it. In order to make such changing of the shape possible, the skeleton of the stretcher 25 is constructed with the frame 13 comprised of round pipes that are assembled in the way that they can be folded. The rotating mechanism of the frame 13 can be constructed by a rotating pair such as a hinge, etc., made from round pipes of different diameters, and the stretching mechanism can be constructed by a sliding pair made from pipes with different diameters. If this frame 13 is made by, for example, a lightweight alloy, the stretcher 25 can be of light weight as well as be able to maintain the necessary strength.

Figure 12:
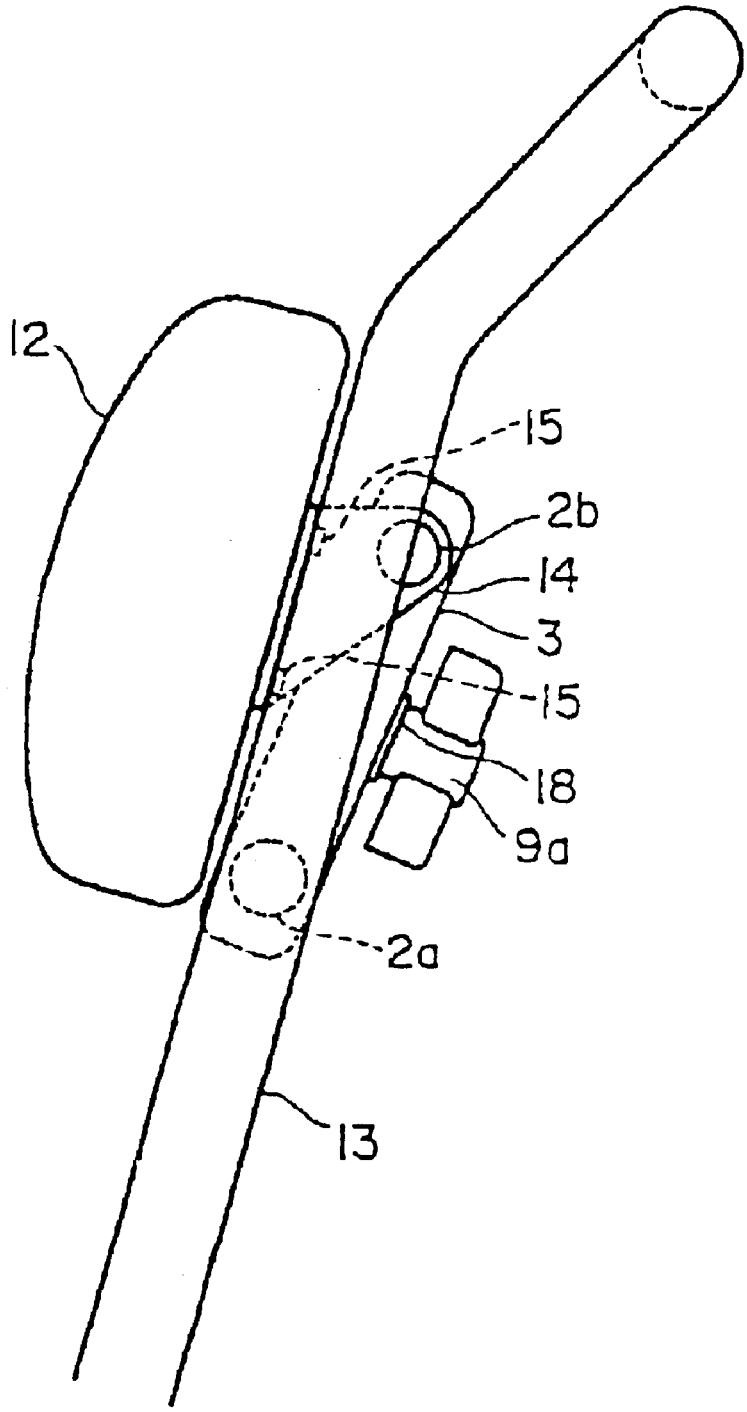
FIG. 12 is a view that indicates the rotation prevention member that was applied for a head rest of the stretcher.
Figure 13:
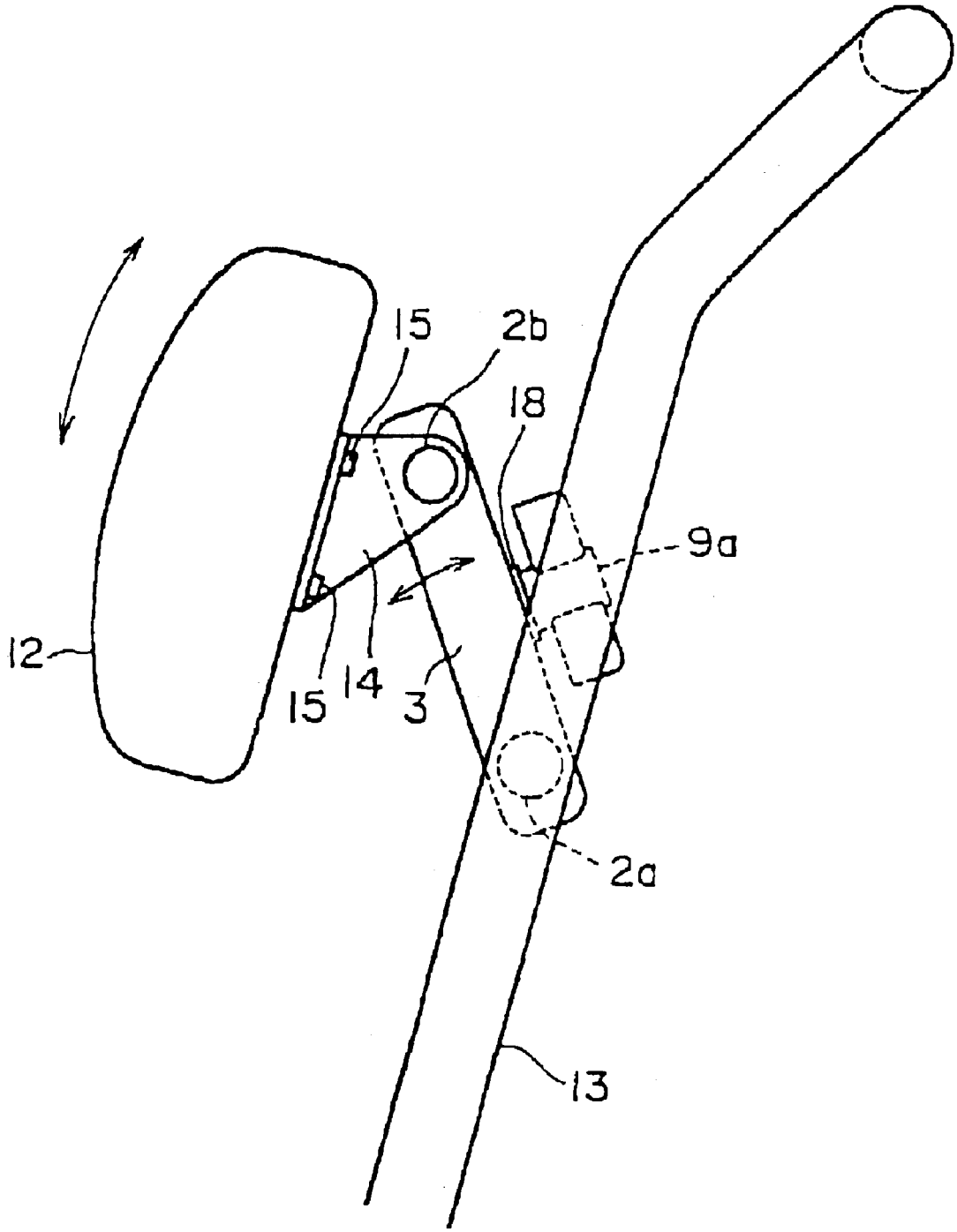
FIG. 13 is a view that indicates the rotation prevention member that was applied for the head rest of the stretcher.
Figure 14:
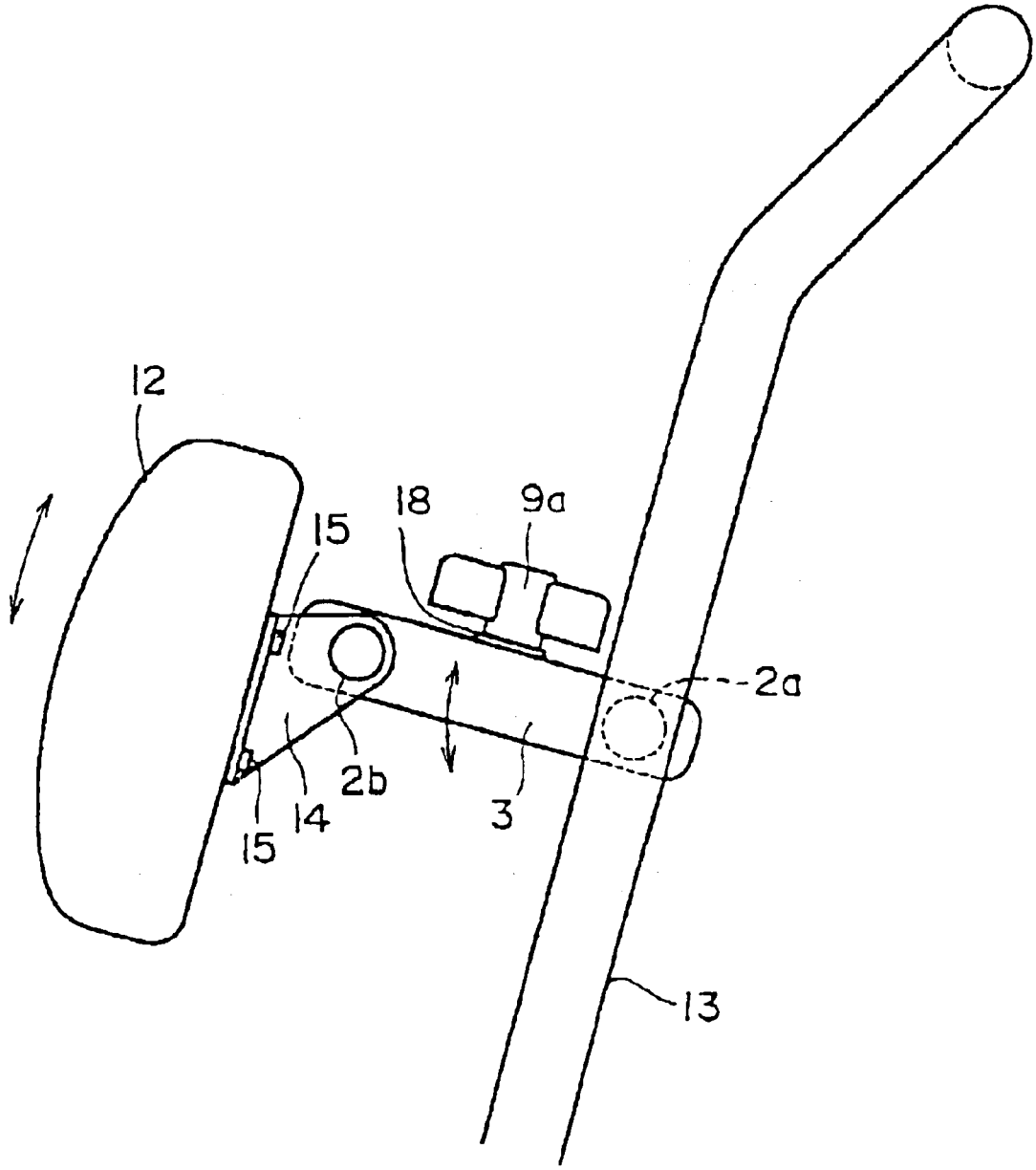
FIG. 14 is a view that indicates the rotation prevention member that was applied for the head rest of the stretcher.

The stretcher 25 has the head rest 12 which can support the head of the patient in either the state of a bed or a wheel chair. As can be seen in FIGS. 12 to 14, this head rest 12 is installed at the tip end of the support arm 3 which can rotate around the first shaft 2*a*, and by this, it can be moved back and forth (or up and down in the bed state, although this is not shown in the figure) on the frame 13 of the stretcher 25 in the wheel chair state, and also the angle of the support surface (in this Description, it is used to mean the surface that supports the head of the patient) of the head rest itself can be adjusted too. For instance, the first shaft 2*a*, made out of pipes, is attached onto the left and right frames 13 by welding, etc., and the support arm 3 is installed onto this first shaft 2*a* in the way that it can rotate.

One pair, left and right, of brackets 14 is provided on the reverse surface (back surface) of the support surface of the head rest 12. Although it is not shown in the figure in detail, this bracket 14 can be folded at the head rest 12 side, and this folded part is fix-attached by the screw 15 in two places (a total of four places on the left and right) on the reverse side of the head rest 12. Also, the second shaft 2*b* made out of pipe, etc., is made into one body with the left and right brackets 14 by welding, etc.

The base end side of the support arm 3 is installed on the first shaft 2*a* in the way that it can rotate, and also it is the member that supports the head rest 12 at the tip end, and it prevents the relative rotational movement of both shafts 2*a* and 2*b* by the rotation prevention mechanism 1 and it fixes the head rest 12 into the desired position and angle, or it can allow the relative rotational movement of both shafts 2*a* and 2*b* to make it possible to change the position of the head rest 12 and the angle of the supporting surface.

This support arm 3 has a first cover 16 and a second cover 17 which are almost equally divided, and it is equipped with the rotation prevention member 6, the wedge shaped member 8 and the load applying means 9. The covers 16, 17 which become a pair have semicircular shaped concave parts, and they form the shaft holes 3*a*, 3*b* that support the shafts 2*a*, 2*b* in a way that they can rotate by being combined with the cover of the other side. In this actual example, the bolt 9*a* and nut 9*b* were used as the load applying means 9, and the pressing sloped part 7 of the wedge shaped member 8 is pressed onto the being pressed sloped part 4 of the rotation prevention member 6 by utilizing the tightening force of the bolt and nut.

Figure 8:
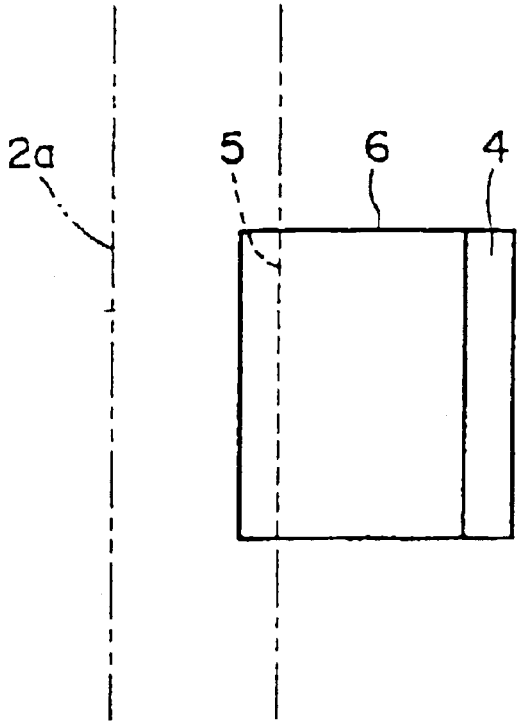
FIG. 8 is a flat view of a rotation prevention member.
Figure 9:
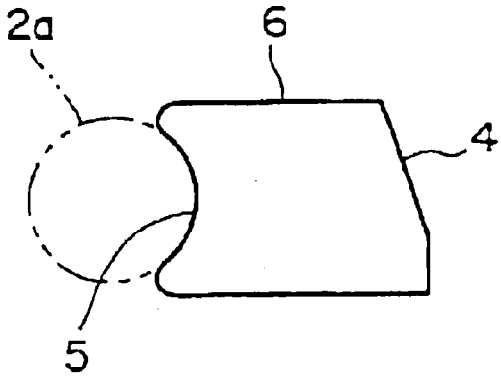
FIG. 9 is a front view of the rotation prevention member.

The rotation prevention member 6 tightens the shafts 2*a* and 2*b* by pressing between them and the bearing surface of the shaft holes 3*a*, 3*b*, and this prevents the rotational movement of the shafts 2*a* and 2*b*. As can be seen in FIGS. 8 and 9 (in both figures, the rotation prevention member 6 on the first shaft 2*a* side is shown), the rotation prevention member 6 has the being pressed sloped part 4 that receives the pressing force and the pressing part 5 that is pressed onto the circumference surface of the shaft 2. As can be seen in FIG. 1, in the rotation prevention member 6, a pair of members with a symmetrical shape are placed in symmetrical positions with the two shafts 2*a*, 2*b*.

The being pressed sloped part 4 of the rotation prevention member 6 is provided to contact with the wedge shaped member 8 as can be seen in FIG. 1, and it receives the pressing force from the wedge shaped member 8 and makes the rotation prevention member 6 shift toward the first shaft 2*a* or the second shaft 2*b*. In the case of this actual example, the being pressed sloped part 4 is a plane of which the slope angle is equal to the slope angle of the pressing sloped part 7, and it surface-contacts with the pressing sloped part 7. The pressing part 5 that comes in contact with the outer circumference surface of the first shaft 2*a* and the second shaft 2*b*, should have the shape with which sufficiently suitable frictional force can be generated to tighten the first shaft 2*a* and the second shaft 2*b* to make them impossible to rotate; for instance, as in this actual example, the shape that is comprised of a semicircular concave surface that matches the circumference shape of the first shaft 2*a* and the second shaft 2*b*, and that can secure a large contact region with each shaft 2*a* and 2*b*, is suitable.

Figure 10:
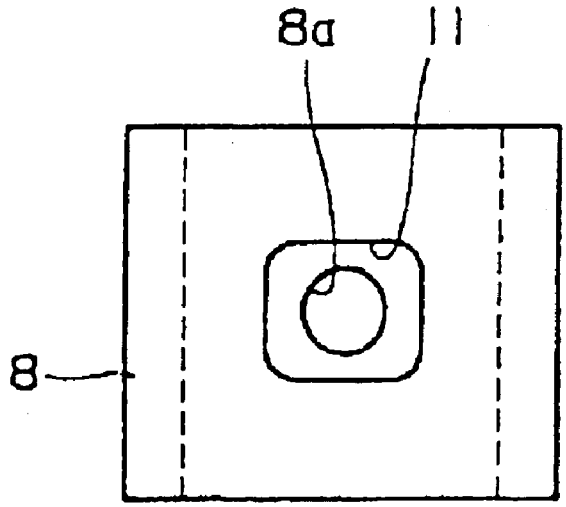
FIG. 10 is a flat view of a wedge shaped member.
Figure 11:
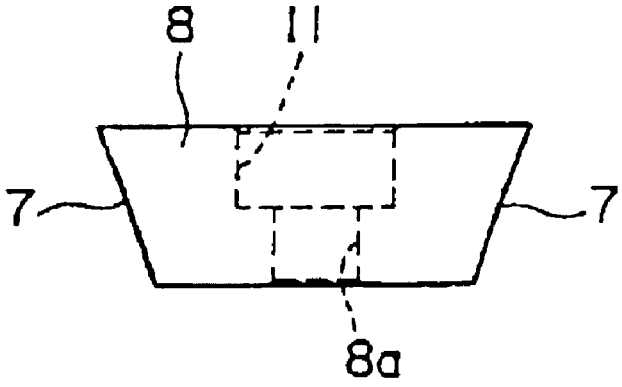
FIG. 11 is a front view of the wedge shaped member.

Wedge shaped member 8 has the pressing sloped part 7 that presses the being pressed sloped part 4 of the rotation prevention member 6 while sliding, and it presses the rotation prevention member 6 onto each shaft 2*a*, 2*b* by the wedging action caused between the pressing sloped part 7 and the being pressed sloped part 4. The wedge shaped member 8 of this actual example has a square flat view as can be seen in FIG. 10, and it is the member which is pseudo trapezoidal from the front view equipped with a pair of symmetrically shaped pressing sloped parts 7 on the surface of the shafts 2*a*, 2*b* sides (FIG. 11). As is shown in the figure, the pressing sloped part 7 is comprised of a flat surface, and it is formed to surface-contact with the being pressed sloped part 4. Also, the penetrating hole 8*a* that allows the screw part of the bolt 9*a* to pass through is provided at the center of this wedge shaped member 8. A part (for instance, about half of the upper side) of this penetrating hole 8*a* is made to be a concave part 11 that is larger than this penetrating hole 8*a* and of a pseudo square shape, and the head of the bolt 9*a* or the nut 9*b* can be kept in the rotation-disabled state so that the slipping of the bolt 9*a* and the nut 9*b* do not occur. In this actual example, the nut 9*b* is fitted into this concave part 11 (FIG. 1).

The bolt 9*a* and the nut 9*b* that function as the load applying means add a load in a way so as to press the wedge shaped member 8 onto the being pressed sloped part 4 of the rotation prevention member 6. In the case of this actual example, the head of the bolt 9*a* is made to be a butterfly shape as can be seen in FIG. 1, and it is made in the way that it can be tightened or loosened manually. For securing easy sliding, the resin washer 18 is provided between the head of the bolt 9*a* and the second cover 17.

Figure 2:
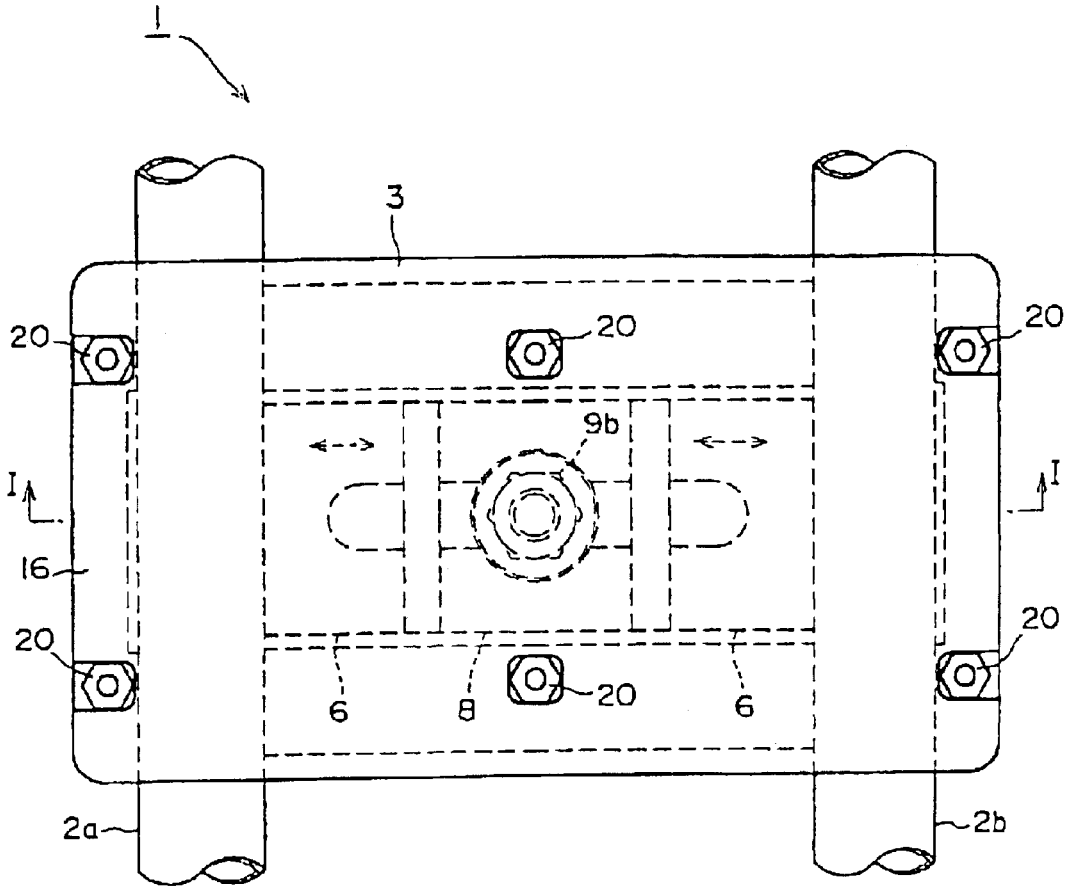
FIG. 2 is a flat view of the rotation prevention mechanism.
Figure 3:
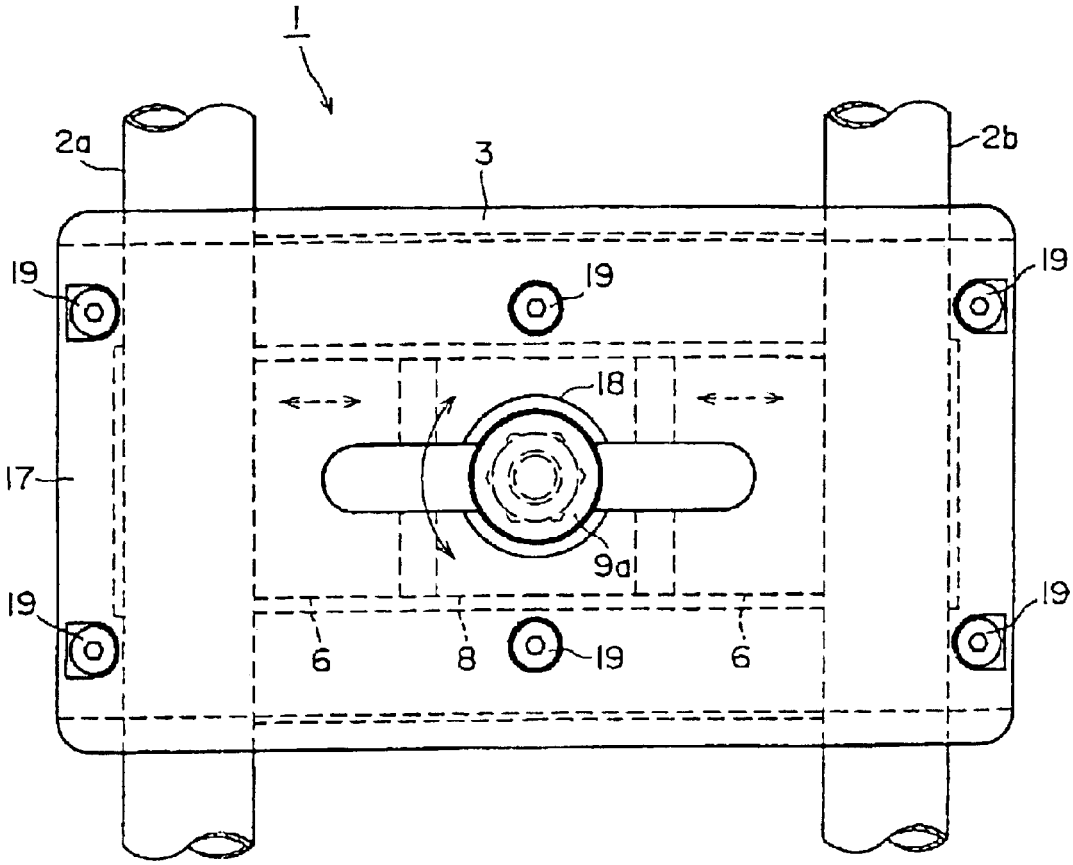
FIG. 3 is a bottom view of the rotation prevention mechanism.
Figure 4:
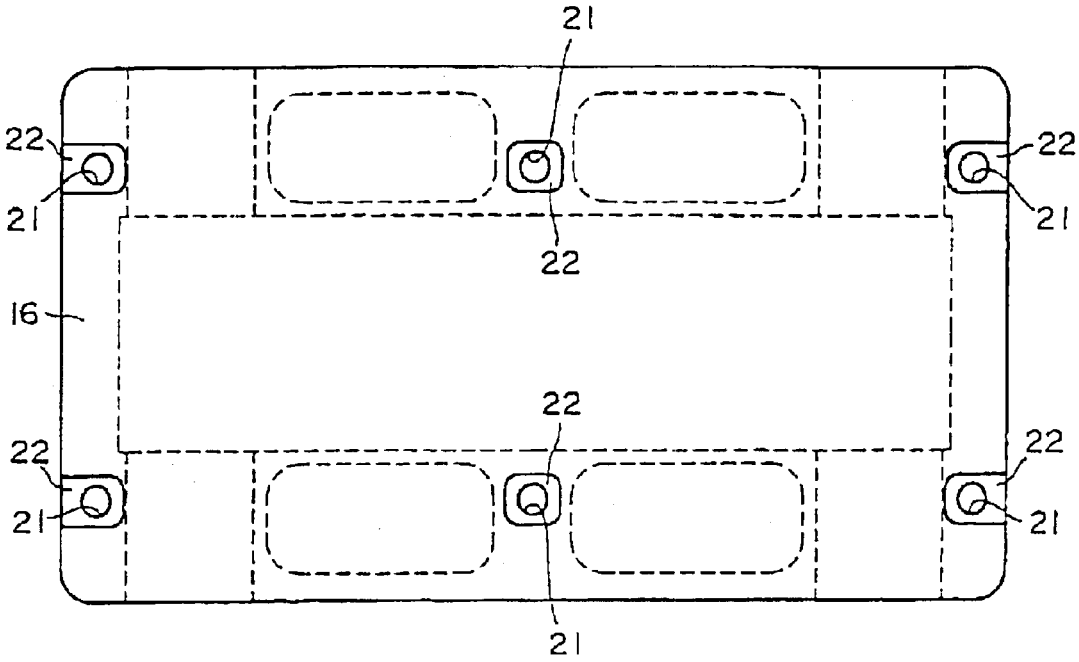
FIG. 4 is a flat view of a first cover.
Figure 5:
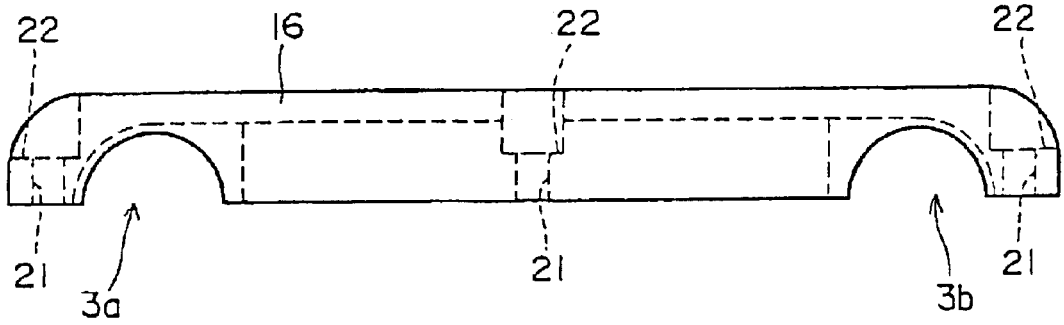
FIG. 5 is a front view of the first cover.
Figure 6:
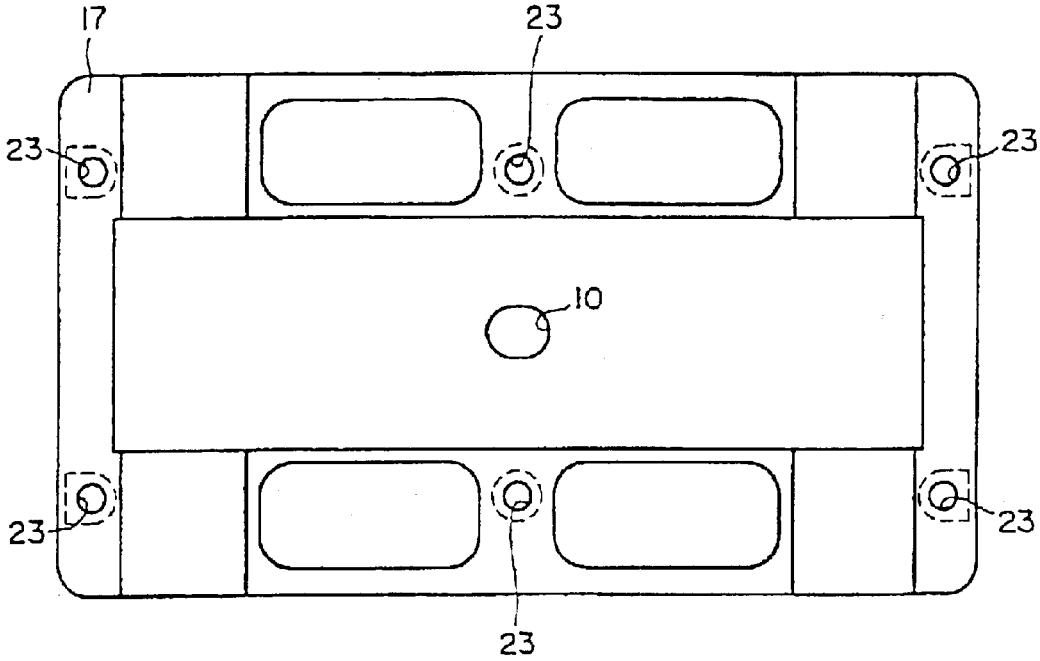
FIG. 6 is a flat view of a second cover.
Figure 7:
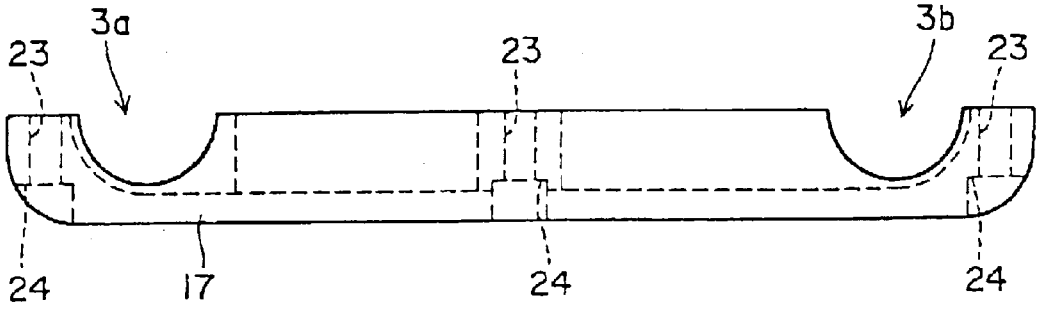
FIG. 7 is a front view of the second cover.

On the covers 16, 17, the penetrating holes 21, 23, with the seats 22, 24 in which the screw part of bolt 19 for tightening the cover can pass through, are provided (FIGS. 4 to 7). In the case of this actual example, the bolt 19 goes through each penetrating hole 21, 23, in the state in which the covers 16, 17 are assembled, and it is fitted with the nut 20 to put together the covers 16, 17. The seat 22 for the nut 20 has, for instance, a wall surface that contacts with the side surface of the nut 20 as is shown in FIG. 2, and it is made to prevent the rotation of the nut 20.

The penetrating hole 10 is provided at the center of the second cover 17 to allow the screw part of the bolt 9*a* to pass through. This penetrating hole 10 may be a round hole, too. However, it is preferred, as in this actual example, for it to be a long hole that extends perpendicular to both shafts 2*a*, 2*b*. In this case, the bolt 9*a* can stroke inside this long hole, therefore, the wedge shaped member 8 can approach to and separate from both shafts 2*a*, 2*b*, by this stroke amount. Therefore, even if a deviation occurs, for instance, the pressing force to one of the rotation prevention members 6 becomes smaller than the pressing force on the other rotation prevention member 6 caused by an error due to the shape of the rotation prevention member 6 or the wedge shaped member 8, such deviation of pressing forces can be absorbed by stroking of the wedge shaped member 8, and it becomes uniform, and these rotation prevention members 6 are pressed to the first shaft 2*a* and the second shaft 2*b* with almost equal forces. Therefore, according to the rotation prevention mechanism 1 of this actual example, both shafts 2*a*, 2*b* can become relatively incapable of rotation at almost the same time, and relatively capable of rotation at almost the same time.

The rotation prevention mechanism 1 of the stretcher of this actual example functions as follows.

First, in the case when both shafts 2*a*, 2*b* are not tightened, the support arm 3 can rotate relative to the frame 13, and also, the head rest 12 can rotate relative to the support arm 3. Therefore, the head rest 12 can be moved in the back and forth direction while maintaining a constant angle as can be seen in FIGS. 13 and 14, or it can be made to be in a desired angle in the desired position, too.

Here, when the head rest 12 is moved to the desired position, and the support surface is adjusted to the desired angle, the bolt 9*a* is rotated and is tightened while maintaining this position and angle. By this, the wedge shaped member 8 is pulled toward the head side of the bolt 9*a*, and the pressing sloped part 7 of the wedge shaped member 8 contacts and presses on the being pressed sloped part 4 of the rotation prevention member 6 while sliding on it. Then, each rotation prevention member 6 moves to the outward direction by receiving this pressing force, and it presses the first shaft 2*a* and the second shaft 2*b* at the pressing part 5, and it squeezes the shafts 2*a*, 2*b* between this and the shaft holes 3*a*, 3*b*, to prevent relative rotation. At this time, both shafts 2*a*, 2*b* are squeezed at almost the same time by almost equal forces, so that the support arm 3 and the head rest 12 can be fixed at the same time by the simple action of rotating and tightening the bolt 9*a*, therefore, the positioning in the back and forth direction and the angle adjustment of the head rest 12 can be done at the same time. In addition, the bolt 9*a* and the nut 9*b* are unlikely to loosen naturally, and they maintain the state in which both shafts 2*a*, 2*b* are tightened, therefore, the head rest 12 is fixed at the desired position and angle, and it will not suddenly move, even in the case of supporting the head.

On the other hand, the pressing force is released when the tightened bolt 9*a* is loosened, and the support arm 3 and the head rest 12 become rotation-enabled again. Therefore, in this state, the back and forth position and the angle of the head rest 12 can be readjusted.

The above-mentioned actual example is an example of a suitable practice of this invention, however it is not limited to this, and it can be changed to various forms as long as it does not go beyond the essential scope of this invention. For instance, in this actual example, the stretcher 25 which uses the rotation prevention mechanism 1 for the head rest 12 is explained; however, this is merely an example of a suitable case and is not limited to this form specifically. For instance, if the same stretcher 25 is equipped with a foot rest that can move back and forth (up and down movement in the bed state) and also of which the angle can be adjusted, this invention can be applied to such a foot rest, too. Further, it can be applied not only for the stretcher like this, but also for any equipment which has the mechanism where two shafts 2 move in relative rotation with regard to the support arm 3, etc., and the easy switching between the rotation prevention state and the allowing state is desired.

Also, although both the being pressed sloped part 4 and the pressing sloped part 7 of this actual example had flat surfaces, this is only an example and is not limited to a flat surface as long as the shafts 2*a*, 2*b* can be tightened by the wedge action. For instance, even if these sloped parts 4, 7 are the curved surfaces that are similar to the flat surface, and as a result, the wedge shaped member 8 is not a perfect trapezoid but has a shape similar to that, the relative rotation of the shafts 2*a*, 2*b* can be prevented as long as the wedge action can be performed.

Further, the pressing part 5 of the rotation prevention member 6 in this actual example was a pseudo semicircular concave curved surface that matched the circumference shape of the shafts 2*a*, 2*b*, however, it is not limited to such shape, and it may be one that surface-contacts with the shafts 2*a*, 2*b* or one that line-contacts it, as long as it appears to show an appropriate frictional force with the shafts 2*a*, 2*b*. An elastomer such as rubber, etc., which elastic-deforms in the pressed condition also may be provided on the pressing part 5 to contact the circumference surface of the shafts 2*a*, 2*b*. Also, although it is not specifically shown in the figures, if a shallow tongue and groove (or up and down undulations) that extend in the axial direction are provided on the contact surface of the pressing part 5 and the circumference surface of the shafts 2*a*, 2*b*, then when they are meshed with each other in the pressed state, the relative rotation of the shafts 2*a*, 2*b* can be securely prevented. Here, the shafts 2*a*, 2*b* in this actual example could rotate relatively without any steps, but in the case when such a tongue and groove are provided, the shafts 2*a*, 2*b* relatively rotate in a step-wise manner relative to the support arm 3.

In this actual example, the rotation prevention mechanism 1 prevents or allows relative rotation of the shafts 2*a*, 2*b*, however, the rotation prevention mechanism 1 can function as the mechanism that prevents or allows sliding of the shafts 2*a*, 2*b* as well. Namely, in the case when two shafts 2*a*, 2*b* (or a greater number of shafts) can slide and move in the axial direction relative to the support arm 3, this sliding can be prevented by tightening the shaft 2 by utilizing the rotation prevention mechanism 1, and it can allow sliding by releasing this tightening. Also, in the case when the shafts 2*a*, 2*b* can slide while rotating, the rotation and sliding can be prevented or allowed at the same time by this rotation prevention mechanism.

Figure 17:
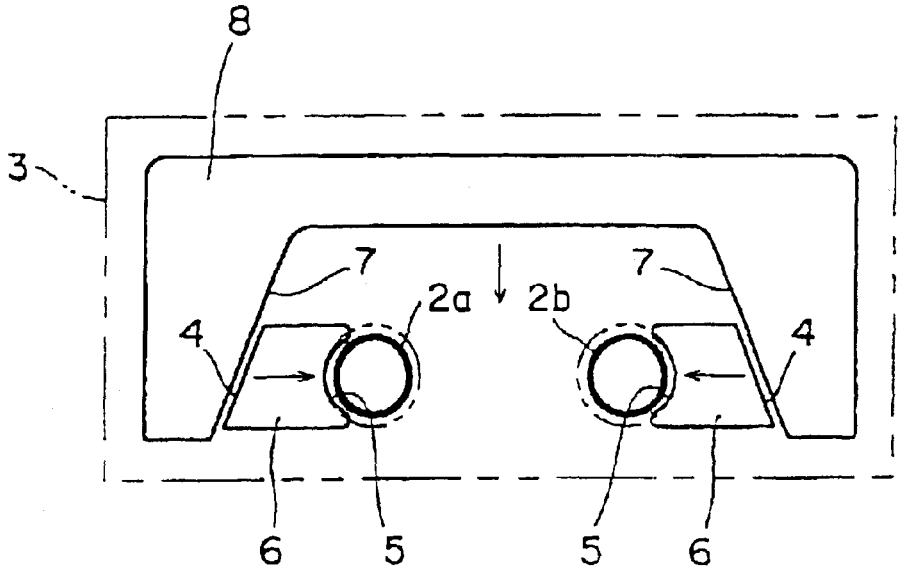
FIG. 17 is a guideline view that indicates another actual example of this invention.

Also, the wedge member 8 in this actual example had the pressing sloped part 7 on its side surface and this pressed the rotation preventing member 6 outward, however, the shape or the action are not limited to this one. For instance, it can be the one which holds both rotation prevention members 6 inside and presses to the outer circumference side of the shafts 2*a*, 2*b*, too. As an example, in the case when the wedge member has a gate shape that straddles both shafts 2*a*, 2*b* and that has the prayer shaped (i.e., the shape of a steep roof) pressing sloped part 7 inside the gate as is the wedge shaped member 8 indicated in FIG. 17, both the rotation prevention members 6 can be pressed inward to tighten the shaft 2.

Also in this actual example, the load was added by sandwiching the wedge shaped member 8 and the second cover 17 by the bolt 9*a* and the nut 9*b*, and the wedge action was naturally released by loosening it, however, in such a structure, a return spring such as a coil spring, etc., also can be provided between the wedge shaped member 8 and the second cover 17, to actively release the pressing force that creates the wedging action.

The form of applying the load to the wedge shaped member is not limited to the one that sandwiches the wedge shaped member 8 and the second cover 17 by the bolt 9*a* and the nut 9*b*. For instance, when the bolt 9*a* of the right screw is reversely rotated, the nut 9*b* moves in the direction of loosening, so that by utilizing this action, the load can be applied in the form of pushing the wedge shaped member 8 in, too.

Figure 18:
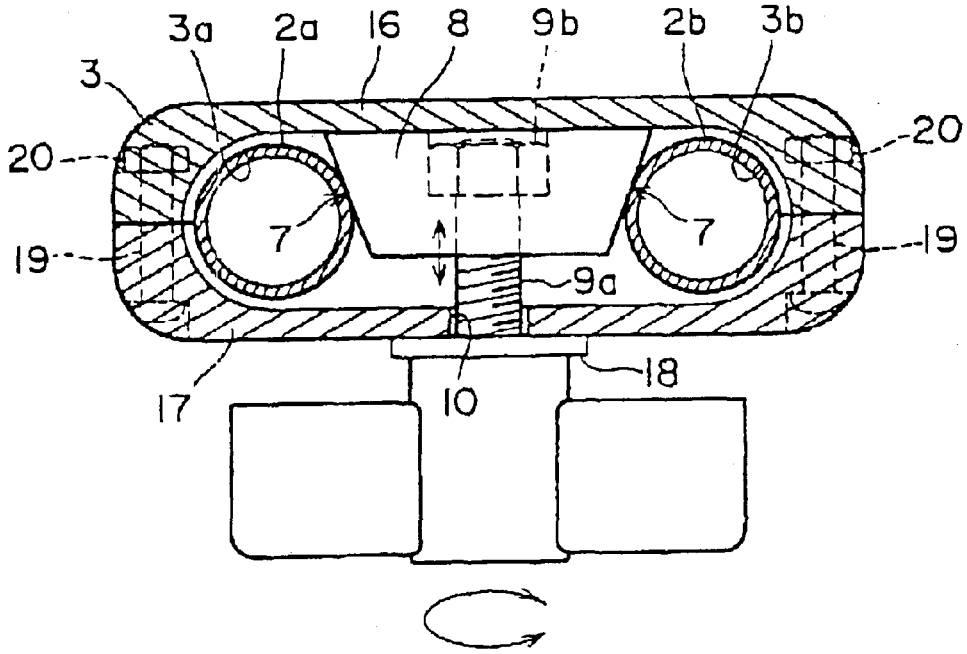
FIG. 18 is a cross section of the rotation prevention mechanism from the front, in which the shaft is directly pressed by the wedge shaped member.

Further, in each above mentioned form, the shafts 2*a*, 2*b* were tightened via rotation prevention member 6. However, as can be seen in FIG. 18, it is also possible to directly tighten these shafts 2*a*, 2*b* by the pressing sloped part 7 of the wedge shaped member 8. In this case, the wedge shaped member 8 strongly presses the shafts 2*a*, 2*b* by the wedging action performed by the pressing sloped part 7, and it tightens between it and the support arm 3 and the relative rotation is prevented. Also in this case, each shaft 2*a*, 2*b* is tightened by the wedge shaped member 8, but an elastomer such as rubber, etc., can be provided, too, on the surface of the pressing sloped part 7 to tighten it indirectly, then the relative rotation of the shafts 2*a*, 2*b* can be securely prevented by the increased contact region. In FIG. 18, the pressing sloped part 7 is a flat surface, however, the shape can be changed appropriately such as to a curved surface that matches the circumference surface of the shafts 2*a*, 2*b*.

In this actual example, the case in which the first shaft 2*a* and the second shaft 2*b* are placed in parallel was explained. However, the range of applying this invention is not limited to this; for instance, this invention can be applied to the case when both shafts 2*a*, 2*b* are not parallel either.

As is clear from the above explanation, the relative rotation prevention state and the relative rotation allowing state between the first shaft and the second shaft and the support arm can be switched at the same time by operating the load applying means. Therefore, the depth adjustment and the angle adjustment of the head rest can be done at the same time, so that it is not a nuisance such as in the case of making adjustments for each separately. Also, the load applying means or the wedge shaped member can be a single member for two shafts, so that it becomes advantageous for reducing the number of parts or for reducing the scale.

The wedge shaped member that was loaded pushes the rotation prevention member on both sides outward by the wedging action caused between the slope parts, and it tightens the shaft between the pressing part of this rotation prevention member and the support arm. By this, the relative rotational movement of the two parallel shafts relative to the support arm is prevented at almost the same time, or can be allowed at almost the same time by removing the load.

The relative rotation preventing state and the relative rotation allowing state between the first shaft and the second shaft and the support arm can be switched at the same time by operating the load applying means. Therefore, the depth adjustment and the angle adjustment of the head rest can be done at the same time, so that it is not a nuisance such as in the case of making each adjustment separately. Also, the load applying means or the wedge shaped member can be a single member for two shafts, so that it becomes advantageous for reducing the number of parts or for reducing the scale.

The load can be applied gradually on the wedge shaped member to tighten the shaft by tightening a nut and bolt. Also, it is unlikely for the nut and bolt to naturally become loose, so that it is easy to maintain the relative rotation prevention state of the shaft.

The concave part that keeps the head of the bolt or the nut in the way that it cannot rotate, is provided in the wedge shaped member, so that the slipping of the bolt ● nut will not occur, and the shaft can be securely tightened or released by rotating the side that is not kept.

The wedge shaped member can move by the amount of the stroke of the long hole, so that any deviations generated between the pressing force on one rotation prevention member and the pressing force on the other rotation prevention member can be absorbed, and the pressing force can be made uniform, and these rotation prevention members can be pressed to each shaft with almost equal force.

What is claimed is:

1. A stretcher having a head rest for supporting the head of the patient, comprising:

a first shaft fixed onto a frame of the stretcher;

a second shaft provided on a head rest;

a support arm installed on the first shaft such that the support arm is rotatable and supporting the second shaft such that the support arm is rotatable;

a rotation prevention member having a pressed sloped part and a pressing part, wherein a pressing force applied against the pressed sloped part is transmitted to the pressing part and the pressing part acts against a circumference surface of the first shaft or the second shaft, and the rotation prevention member is rotatably adjustable about the first shaft or the second shaft;

a wedge shaped member having a pressing sloped part, which presses while sliding on the pressed sloped part of the rotation prevention member, thereby causing the pressing sloped part to press the rotation prevention member onto the first shaft or the second shaft by a wedge action caused between the pressing sloped part and the pressed sloped part; and means to apply a load, the means to apply a load adds a load onto the wedge member and maintains the state in which the first shaft and the second shaft are tightened, wherein an angle of the support arm around the first shaft and the angle of the head rest to the support arm are fixable at the same time.

2. The stretcher as claimed in claim 1, wherein:

the first shaft and the second shaft are parallel;

the rotation prevention member includes a pair of members that press the first shaft and the second shaft from an inside to an outward direction; and the wedge shaped member is such that the being-pressed sloped part has a trapezoidal shape including a pair of sloped flat surfaces or surfaces that are similar to sloped flat surfaces, and the wedge shaped member exists between a pair of rotation prevention members and presses the first shaft and the second shaft outside by being loaded via the means to apply a load.

3. The stretcher as claimed in claim 2, wherein the means to apply a load is a nut and bolt, and a penetrating hole that allows a screw part of the bolt to pass through is provided on one side surface of the support arm and the wedge shaped member.

4. The stretcher as claimed in claim 1, wherein the means to apply a load is a nut and bolt, and a penetrating hole that allows a screw part of the bolt to pass through is provided on one side surface of the support arm and the wedge shaped member.

5. The stretcher as claimed in claim 4, wherein the wedge shaped member has a recess that conforms to a head of the bolt or the nut to prevent rotation of the bolt or nut.

6. The stretcher as claimed in claim 4, wherein the first shaft and the second shaft are parallel, a penetrating hole is provided on one side surface of the support arm and the wedge shaped member has a long hole extending to each of the first shaft and the second shaft, wherein the wedge shaped member comes near to or separate from both shafts.

7. A stretcher equipped with a head rest to support the head of the patient, comprising:

a first shaft fixed onto a frame of the stretcher;

a second shaft provided on the head rest;

a support arm pivotally mounted upon the first shaft such that the support arm is rotatable and wherein the second shaft is mounted within the support arm in a way that the support arm is rotatable relative to the first shaft and the second shaft;

a wedge shaped member movable in a direction to contact the first shaft and the second shaft, and pressable onto the first shaft and the second shaft directly or indirectly by the wedging action on sloped surfaces, and by this wedging action, the wedge shaped member tightens the first shaft and the second shaft between the wedge shaped member and the support arm and prevents relative rotation; and means to apply a load, the means to apply a load adds a load onto the wedge shaped member in the direction of pressing the first shaft and the second shaft, and maintains the state in which the first shaft and the second shaft are tightened, wherein an angle of the support arm around the first shaft and the angle of the head rest to the support arm are fixable at the same time.

8. The stretcher as claimed in claim 3, wherein the means to apply a load is a nut and bolt, and a penetrating hole that allows a screw part of the bolt to pass through is provided on one side surface of the support arm and the wedge shaped member.

* * * * *

UNITED STATES PATENT AND TRADEMARK OFFICE

CERTIFICATE OF CORRECTION

PATENT NO. : 6,811,223 B2
DATED : November 2, 2004
INVENTOR(S) : Ito

It is certified that error appears in the above-identified patent and that said Letters Patent is hereby corrected as shown below:

Title page,
Insert item:
-- [30] Foreign Application Priority Data
JP 2001-324087 10/22/01 --

Column 10,
Line 40, "the being-pressed" should read -- the pressed --

Column 12,
Line 9, "claim 3" should read -- claim 7 --

Signed and Sealed this

Seventeenth Day of May, 2005

JON W. DUDAS
*Director of the United States Patent and Trademark Office*